US007044466B2

(12) United States Patent
Laibson et al.

(10) Patent No.: US 7,044,466 B2
(45) Date of Patent: May 16, 2006

(54) FOOD RECIPE GAME

(76) Inventors: Richard Laibson, 59 Lookout Dr., Asheville, NC (US) 28804-3353; Barbara Laibson, 59 Lookout Dr., Asheville, NC (US) 28804-3353

( * ) Notice: Subject to any disclaimer, the term of this patent is extended or adjusted under 35 U.S.C. 154(b) by 0 days.

(21) Appl. No.: 10/843,934

(22) Filed: May 11, 2004

(65) Prior Publication Data

US 2004/0227289 A1 Nov. 18, 2004

Related U.S. Application Data

(60) Provisional application No. 60/470,030, filed on May 12, 2003.

(51) Int. Cl.
*A63F 3/00* (2006.01)

(52) U.S. Cl. ..... 273/243; 273/256; 273/278

(58) Field of Classification Search ..... 273/243, 273/272, 430, 431, 256, 278
See application file for complete search history.

(56) References Cited

U.S. PATENT DOCUMENTS 3,799,550 A * 3/1974 Milana et al. ..... 273/243
4,040,628 A 8/1977 Pope
4,398,721 A 8/1983 McKay
4,730,831 A 3/1988 De Sio
4,986,757 A 1/1991 Mueller
5,005,839 A 4/1991 Ryan et al.
5,676,369 A * 10/1997 DeWeese ..... 273/249
6,315,292 B1 * 11/2001 Howlett et al. ..... 273/236
6,428,320 B1 8/2002 Archuleta et al.
2003/0173741 A1 * 9/2003 Pellham ..... 273/292

* cited by examiner

*Primary Examiner*—Vishu K. Mendiratta
(74) *Attorney, Agent, or Firm*—Carter, Schnedler & Monteith, P.A.

(57) ABSTRACT

There is provided a food preparation recipe game and a method for playing the game. A spin wheel having a pointer is provided and includes a plurality of encoded possible landing spaces. A plurality of recipe cards is provided, each of which lists a plurality of ingredients. A plurality of question and answer cards are also provided. Each question and answer card has a plurality of questions and answers which are encoded for various degrees of difficulty. The encoding for the landing spaces on the spin wheel corresponds to the encoding for the question and answer cards. A plurality of ingredient cards are provided. Each ingredient card lists an ingredient for a food recipe, which ingredient may or may not correspond to an ingredient of a particular recipe card. Each player is entitled to draw an ingredient card by correctly answering a question from a question and answer card and the first player to complete his recipe is the winner.

22 Claims, 7 Drawing Sheets

Your vegetable garden has yeilded a bumper crop this year – this card replaces any green vegetable needed for your recipe.

66

56

A range fire causes you to lose your ingredients and singe your eyebrows!

68

56

FOOD RECIPE GAME

RELATIONSHIP TO PRIOR APPLICATION

This is a U.S. non-provisional application relating to and claiming the benefit of U.S. Provisional Patent Application Ser. No. 60/470,030, filed May 12, 2003.

BACKGROUND OF THE INVENTION

This invention relates to food oriented games, more particularly, it relates to food recipes. Games providing useful information to the players, while at the same time providing entertainment, have become popular. One popular game is called Trivial Pursuit. Trivial Pursuit involves players traveling around a board by rolling a die. Each space is associated with a particular category. For example, in the Silver Screen edition, the categories are Settings, Titles, Off Screen, On Screen, Production and Portrayal. Upon landing on a space, a player is asked a question. If answered correctly, the player rolls again. There is only one headquarter space for each category. If a player lands on a headquarter space and answers a question correctly, the player receives a wedge. When a wedge is obtained for each category, the player must move on to the center of the board and answer the question correctly to win.

Another popular educational and entertainment game is the home version of the television show Jeopardy. In Jeopardy, the players pose questions in response to an answer. The answers are divided among several categories. A player selects an answer based on a designated dollar value of the category. The first player to ring in may attempt to pose a correct question. If the player poses the correct question, the player wins the designated amount. If the player answers incorrectly, the player loses the designated amount and other players can ring in to answer correctly. The winner is the player with the most money at the end of the game.

There are very few entertainment and educational games which relate to food. U.S. Pat. No. 3,799,550 issued to Milana shows a board game which teaches food recipes. In the Milana game, each player is given a specific recipe card bearing a certain color. Each player's game piece bears the same color as his or her respective recipe card. The board game represents a zigzag stair path from the attic of a house to the kitchen. A spin wheel is used to determine the number of moves of a player. When a player lands on his or her color, the player is entitled to advance. When a player lands on an opponent's color or on a step occupied by an opponent, there are penalties.

There is a need for a game which teaches recipes, in particular, gourmet recipes and further, that teaches wines that enhance the meal created from the recipe while at the same time is entertaining.

SUMMARY OF THE INVENTION

In accordance with one form of this invention, there is provided a method of playing a food preparation recipe game by a plurality of players, including the steps of randomly selecting recipe informational media, preferably cards, which list a plurality of ingredients of a food recipe; randomly selecting a predetermined question; asking the question of a player; upon the player correctly answering the question, selecting ingredient informational media, preferably a card, which lists a food preparation ingredient, which may or may not correspond to one of the ingredients on the recipe informational media; the first player accumulating all of the ingredients listed on his recipe informational media wins the game.

In accordance with another form of this invention, there is provided a method of playing a food preparation recipe game, including the steps of providing a plurality of recipe informational media, preferably cards, which list a plurality of ingredients for a food recipe; selecting one of the recipe informational media; providing a plurality of question and answer informational media, preferably cards; randomly selecting a question from the question and answer informational media and asking a player the question; providing a plurality of ingredient informational media, preferably cards; upon the player answering the question correctly, selecting one of the ingredient informational media; wherein the first player to accumulate all of the ingredients listed on his recipe informational media wins the game.

Preferably, the recipe informational media lists a wine which is appropriate for the recipe. In addition, it is preferred that wine informational media, preferably cards, which list wines are included. In addition, it is preferred that once all of the ingredient informational media have been selected, a player may select an ingredient informational media from an opposing player upon providing the correct answer to a question. In addition, it is preferred that player action informational media, preferably cards, are provided which require a player to take certain actions which may be positive or negative with respect to such player.

In accordance with another form of this invention, there is provided a food preparation recipe game for one or more players, including a spin wheel having a pointer and a plurality of encoded possible landing spaces; a plurality of recipe cards are provided, each of which lists a plurality of ingredients; a plurality of question and answer cards are provided; each question and answer card has a plurality of questions and answers which are encoded for various degrees of difficulty; encoding on the landing spaces correspond to the encoding for the question and answer cards; a plurality of ingredient cards are included; each ingredient card listing an ingredient for a food recipe, which ingredient may or may not correspond to an ingredient on a particular recipe card; whereby a player is entitled to draw an ingredient card by correctly answering a question from said question and answer card.

BRIEF DESCRIPTION OF THE DRAWINGS

The subject matter of the invention is set forth in the appended claims. The invention itself, together with further objects and advantages thereof may be better understood in reference to the following description taken in conjunction with the accompanying drawings in which:

DESCRIPTION OF THE PREFERRED EMBODIMENT

The object of the game is to collect all necessary ingredients to prepare a randomly selected recipe. A wine card is also collected to enhance the meal. The winner of the game is the person who completes his or her recipe first.

Figure 1:
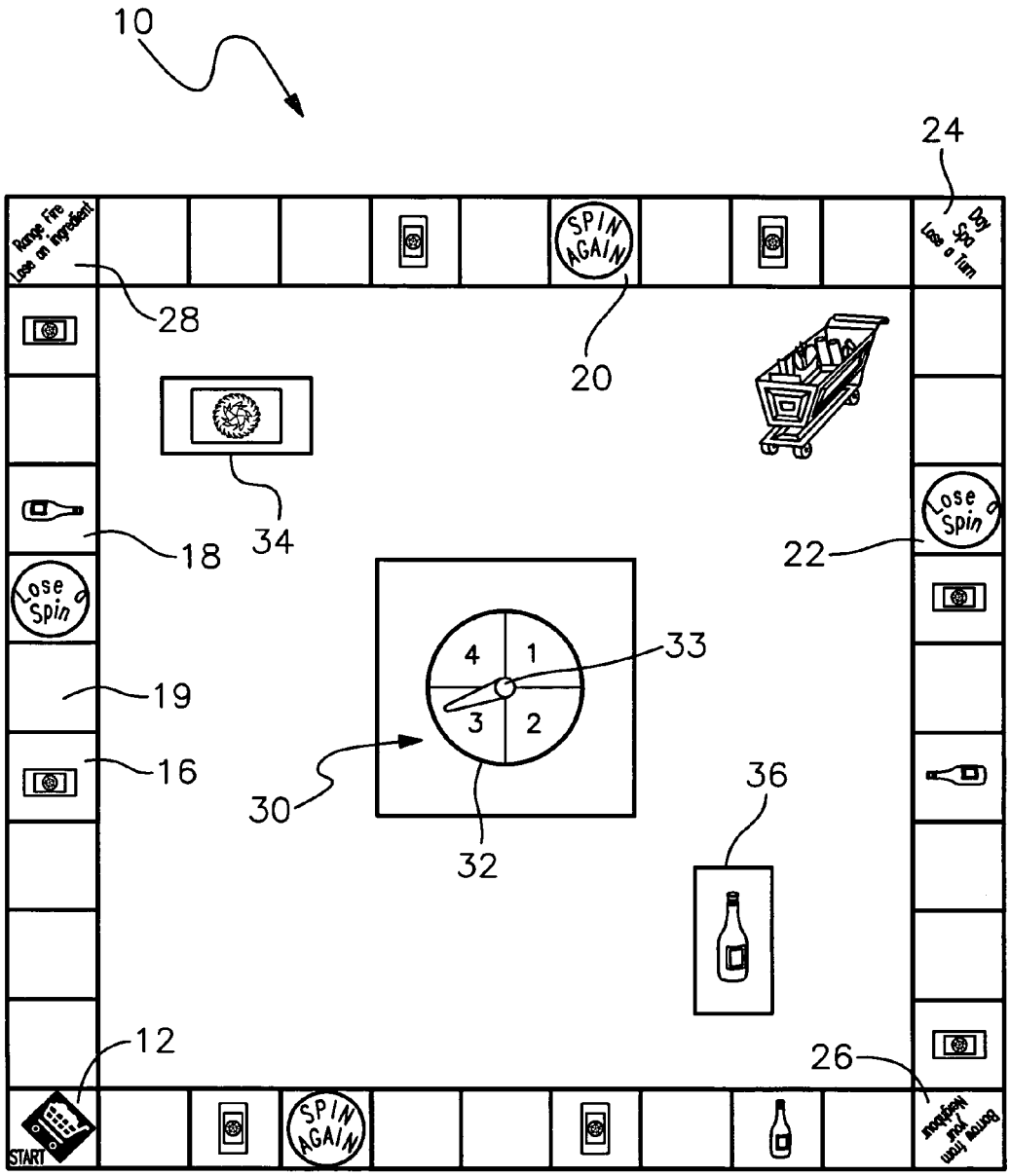
FIG. 1 illustrates a board which may be used in one embodiment of the game of the present invention.
Figure 2:
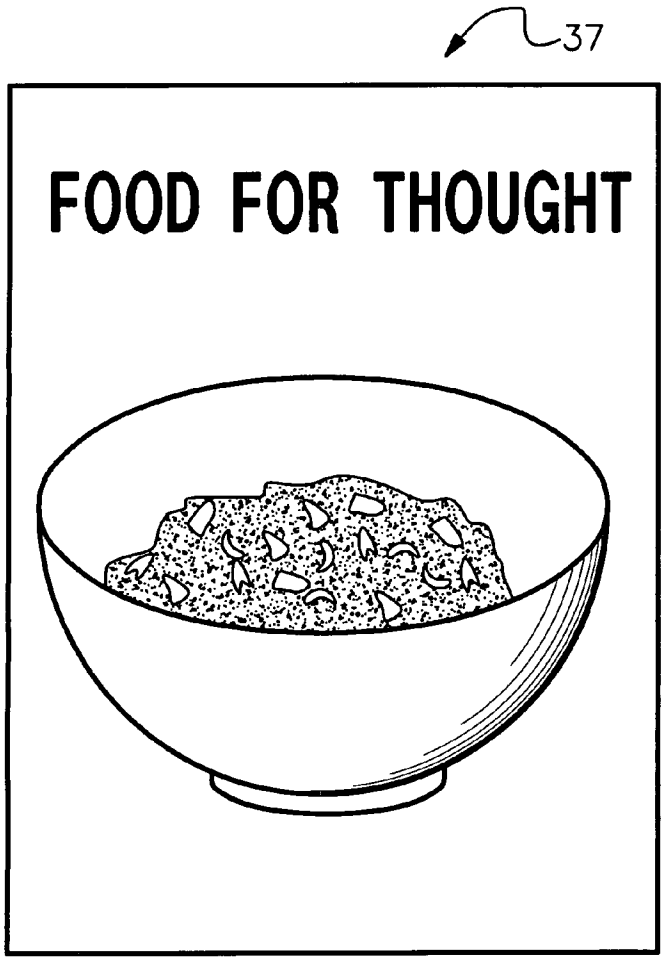
FIG. 2 illustrates the front of a recipe card.
Figure 3:
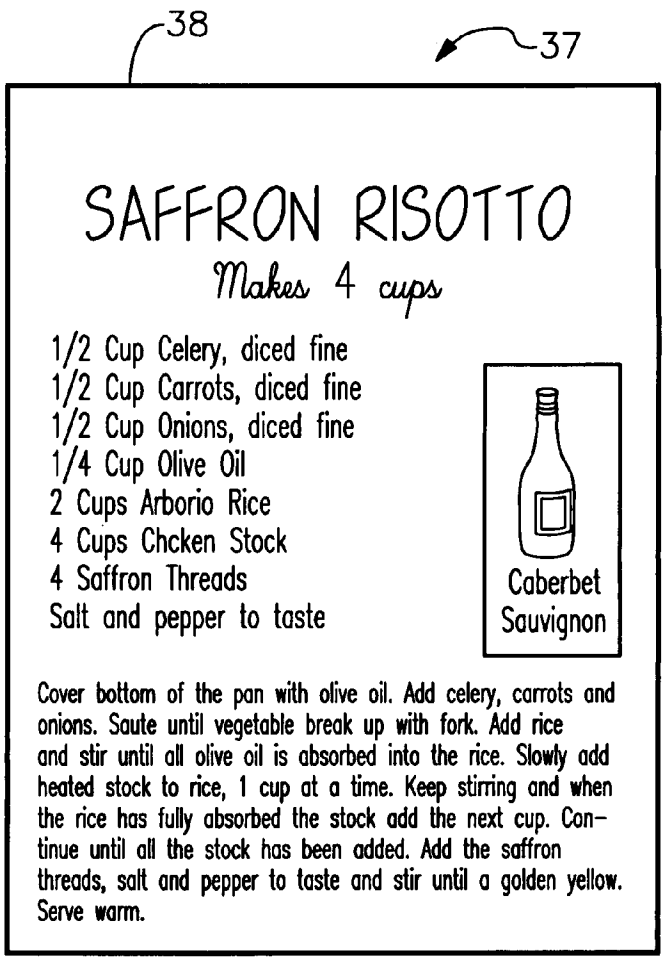
FIG. 3 illustrates the back of a recipe card which includes a complete recipe, including a selected wine.
Figure 4:
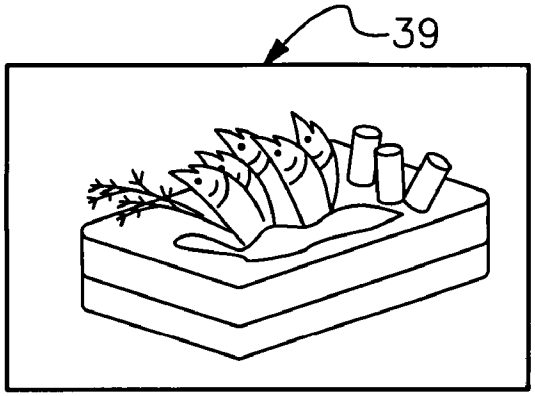
FIG. 4 illustrates the front of an ingredient card.
Figure 5:
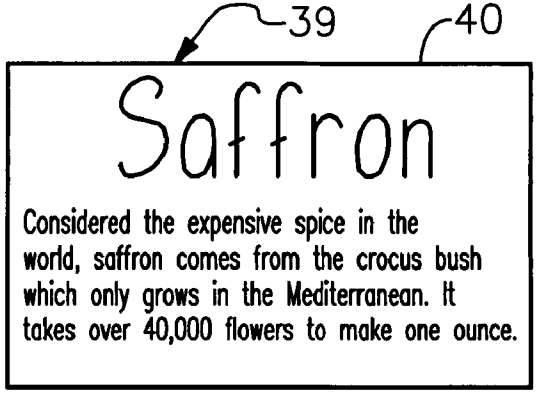
FIG. 5 illustrates the back of an ingredient card.
Figure 6:
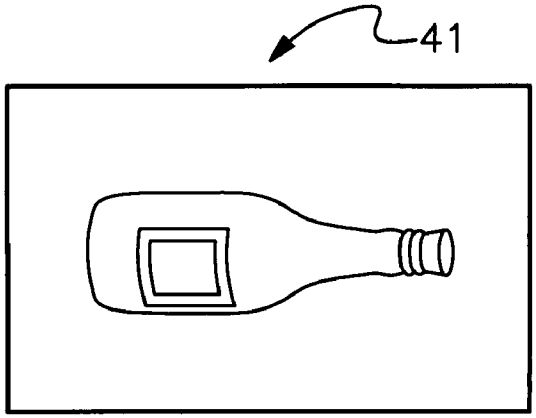
FIG. 6 illustrates the front of a wine card.
Figure 7:
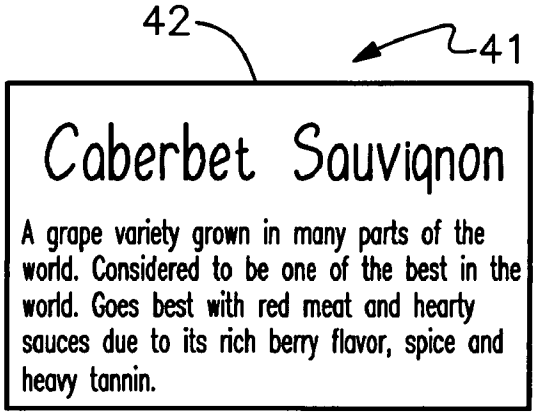
FIG. 7 illustrates the back of a wine card.
Figure 8:
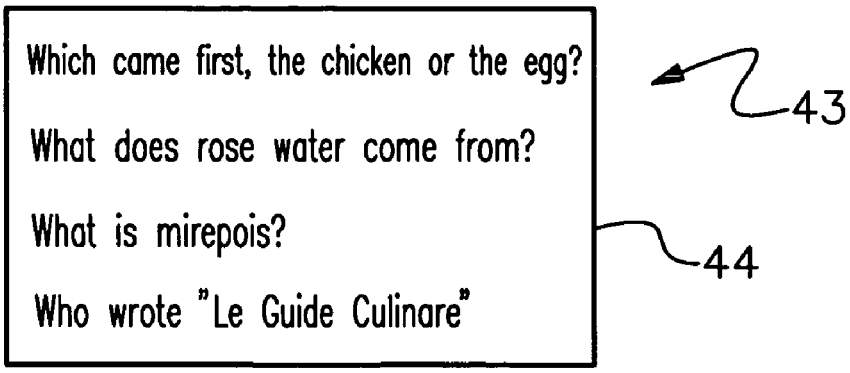
FIG. 8 illustrates the front of a question and answer card which contains four (4) questions.
Figure 9:
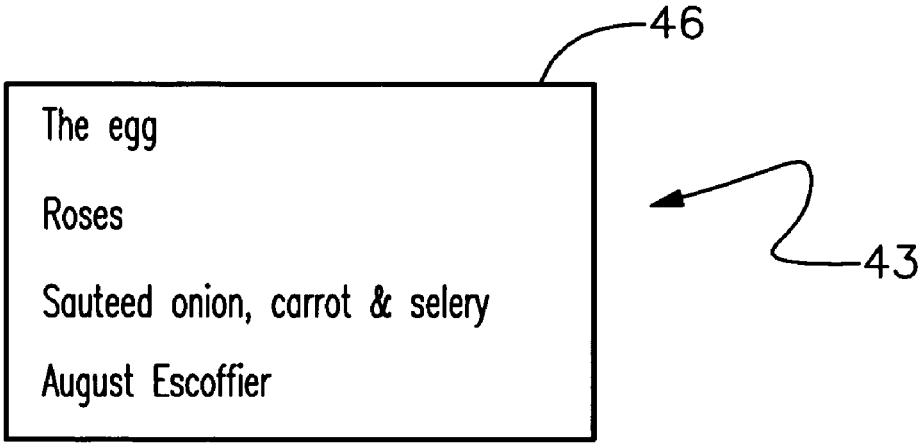
FIG. 9 illustrates the back of a question and answer card, which contains the four (4) answers to the questions.
Figure 10:
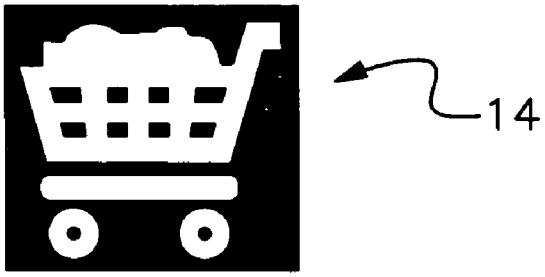
FIG. 10 illustrates a player's moving piece which may be used with the embodiment of FIG. 1.

Referring now more particularly to FIG. 1, which illustrates a board which may be used with the board version of the game, there is provided a game board 10 having a circumferential border defining four (4) rows, including play locations consisting of individual boxes. The players all start at box 12 using individual player pieces 14 as shown in FIG. 10. Each of the four (4) rows includes two (2) ingredient spaces 16. Each of the four (4) rows includes a wine space 18. In addition, two of the rows include a spin again space 20 and two of the rows include a lose a spin space 22. There is a day spa space 24 at the intersection of two (2) rows. There is a borrow from your neighbor space 26 at the intersection of two (2) rows. There is a range fire space 28, also at the intersection of two (2) rows.

Spin wheel 30 is located at the center of the board 10. The spin wheel includes (a) circle 32 divided into four quadrants numbered 1 through 4, each of which is encoded with a different color, and (b) rotatable pointer 33. Ingredient informational media, which are preferably ingredient cards 39, are located within space 34 and wine informational media, which are preferably wine cards, are located within space 36. Also included are game racks 58, shown in FIG. 12, having an active recipe area 60 and a pantry and wine cellar area 62.

The game also includes a plurality of recipe informational media, which are preferably recipe cards 37. The back side 38 of each recipe card lists the recipe for a meal, preferably a gourmet meal, including the ingredients and the method for using the ingredients to make the meal. The recipe cards also include the name of a wine which will go well with the meal.

The back side 40 of each ingredient card 39 includes an ingredient from one or more of the recipe cards 37 and also provides educational information about the particular ingredient. There are also wine informational media, which are preferably wine cards 41. The back side 42 of each wine card lists a wine as well as some educational information about the particular wine, as well as what foods the wine goes with.

The game further includes question and answer informational media, which are preferably question and answer cards 43. The front side 44 of each question and answer card includes four (4) questions, each encoded with a different color. The back side 46 of each question and answer card shows the four (4) answers to the questions, in the colors corresponding to the questions.

In the board version of the game, there are 250 question and answer cards which include 1,000 food oriented questions and 1,000 answers to the questions. 250 of the questions and answers are in red, 250 of the questions and answers are in dark blue, 250 of the questions and answers are in light blue, and 250 of the questions and answers are in yellow.

The four (4) quadrants of circle 32 of spin wheel 30 are divided into red, dark blue, light blue and yellow, corresponding to the colors of the questions and answers on the question and answer cards. Each quadrant includes a number 1 through 4. The number of spaces moved by a player is determined by the number landed on by the spin wheel pointer 33. In addition, the color that the spin wheel pointer 33 lands on will determine the question from the question card side 44. The color and number of spaces moved by a player is set forth below.

Dark Blue—Novice—1 space
Red—Intermediate (Soux Chef)—2 spaces
Yellow—Difficult (Chef di Cuisine)—3 spaces
Light Blue—Most Difficult (Master Chef)–4 spaces How the Board Version of the Game is Played Players pick a recipe card 37 randomly. Players spin the rotatable pointer 33 and the highest number goes first. In the case of a tie, the players spin again. Each player chooses a different color shopping cart 14 for a game piece. The first player spins the pointer 33 to determine which color question gets selected. Each color represents a different number of spaces to move their cart. An opponent selects a question and answer card 43 and reads a question from front question side 44 corresponding to the color landed on. The more spaces which a player might move, the higher degree of difficulty of the question. If the question is answered correctly, as determined by the back answer side 46 of card 43, the player moves the number of spaces corresponding to the number in the quadrant of circle 32 which the pointer 33 landed on. If a player lands on space 16 marked "ingredient," the player picks up the top ingredient card 39 from the stack of ingredient cards on space 34. If the ingredient card is an ingredient from the player's recipe card 37, the player keeps the ingredient card in the active area 60 of his rack 58 and spins again and another question is selected. If the ingredient card selected is not an ingredient from the player's recipe card, the ingredient card is placed in the pantry and wine cellar area 62 of his rack 60 and another player spins pointer 33. If a player lands on a blank space, such as blank space 19, play goes to the next player. If a player lands on a wine space, such as wine space 18, the player picks a wine card 41 from space 36. If the wine on the back side 42 of the wine card pairs with the wine on the player's recipe card 37, the player keeps the wine card in active area 60 and spins again. If the wine does not pair with the wine on the player's recipe card 37, the player places it in the pantry and wine cellar area 62 and the next player spins. Thus it continues until one player completes his or her recipe, including the wine, from the back side 38 of recipe card 37.

The following obstacle spaces make the game more interesting when landed on. If a player lands on day spa 24, the player is overweight and, thus, loses one turn. If a player lands on range fire 28, the player's range has caught on fire and the player loses one turn while the player cleans up the mess. If a player lands on borrow from your neighbor space 26, unexpected guests are coming and you need to borrow an ingredient from your neighbor. One may take any ingredient that one can use to complete his or her recipe card from any other player.

Figure 11:
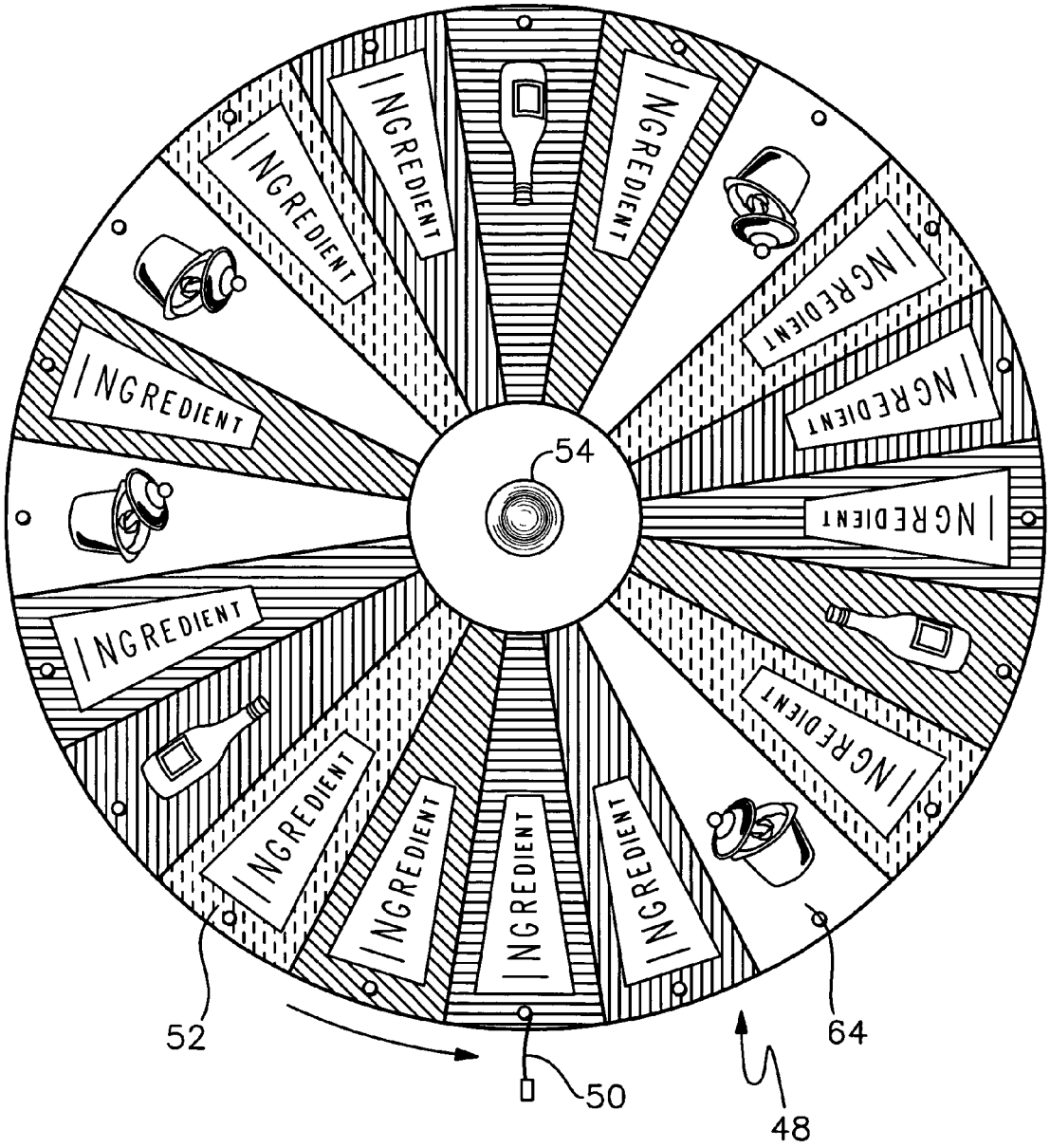
FIG. 11 illustrates a pinwheel which may be used in another embodiment of the game of the present invention.

Referring now more particularly to FIG. 11, which illustrates an alternative embodiment of the invention which does not utilize a board and moving pieces, there is provided spin wheel 48. Spin wheel 48 includes a plurality of possible landing spaces and a fixed pointer 50 and a plurality of possible landing spaces for the pointer, such as space 52, and a manual spinning handle 54 is located at the middle of the spin wheel. Space 52 is colored red, purple, green or blue to correspond with the colors of the food oriented questions on question and answer cards 43. Each space 52 is also marked as an ingredient space, a wine space, or a pot luck space.

Figure 12:
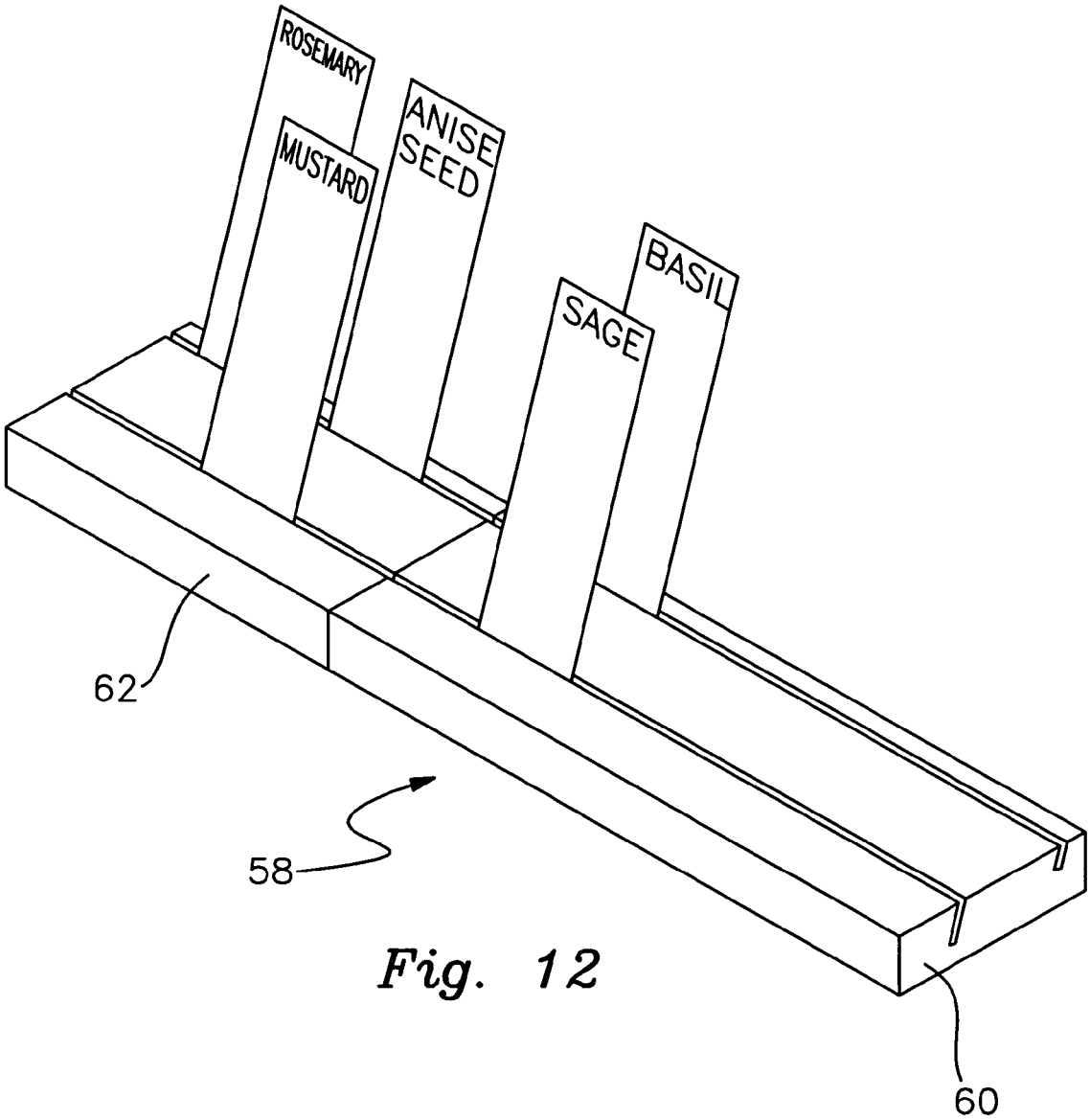
FIG. 12 illustrates a card rack.
Figures 13, 14, 15:
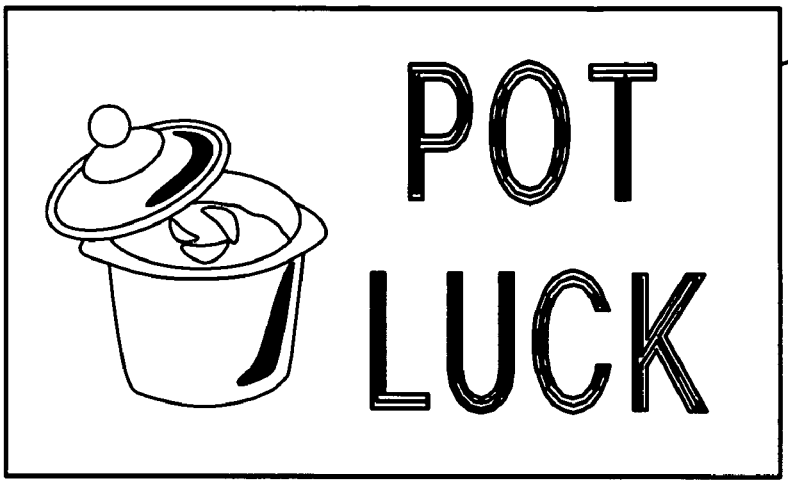
FIG. 13 illustrates the front of a pot luck card.
FIG. 14 illustrates the back of a pot luck card which contains positive player action.
FIG. 15 illustrates the back of a pot luck card which contains negative player action.

The non-board version of the game includes one (1) die (not shown), 60 ingredient cards 39, 50 player action informational media which are preferably pot luck cards 56, 30 wine cards 41, 6 game racks 58, as shown in FIG. 12, 25 recipe cards 37 in a card file box (not shown) suitable for use in the kitchen, 250 question and answer cards 43 and a device for randomly selecting questions from a question and answer card 43 and for randomly determining the selection of an ingredient card 39, a wine card 41, or a pot luck card 56, such as a spin wheel 48. An ingredient card 39 or a wine card 41 may be selected only if the player correctly answers the question from question and answer card 43.

The question and answer cards 43 have a series of 1,000 food oriented questions which are color coded: 250 red, 250 purple, 250 green and 250 blue. The degree of difficulty of the question is determined by the color of the question with red being the most difficult. The order of difficulty is as follows:

Blue—Novice (Apprentice)

Green—Intermediate (Sous Chef)

Purple—Difficult (Chef di Cuisine)

Red—Most Difficult (Master Chef)

Recipe cards 37 include a fully functional recipe consisting of eight (8) ingredients and details of preparation thereof with a wine which is appropriate for the recipe.

Ingredient cards 39 are a specific ingredient needed to complete a recipe. An interesting description of each ingredient is included on the card and may be read aloud. A wild card ingredient may also be included, which is good for any ingredient.

Wine cards 41 include a carefully selected wine accompaniment to each recipe.

Pot luck cards 56 require player action. When landing on a pot luck space on spin wheel 48, a player chooses the top pot luck card from the stack and must follow the directions given. Opponents may not steal this card. Unless the card says to keep it, it must be replaced at the bottom of the pile of the other pot luck cards.

How the Non-Board Game is Played

Each player maintains cards in two different areas on his rack 58. One is the active recipe area 60 (black section) and the other is the pantry and wine cellar 62 (green section). Before play begins, each player (or team) picks a recipe card 37 randomly and does not show the other players. At this time, each player also picks six (6) ingredient cards 41 and places them in the proper position on their rack 58; those ingredients that are part of a player's recipe from his recipe card 37 are placed in the active recipe area 60 and those that are not are placed in the pantry and wine cellar area 62. Players roll the die and the highest number goes first. In the case of a tie, the tied players roll again. All play proceeds clockwise. The first player spins the wheel 48 to determine his action. He will answer a question from a question and answer card 43 of a color corresponding to the color of the space on which the pointer of the spin wheel 48 lands to win an ingredient card 39, answer a question to win a wine card 41, or choose a pot luck card 56 from the top of the deck. All cards should be read aloud. An opponent, or designated reader, selects a question and answer card 43 from the question box and reads the question corresponding to the color on which the wheel's pointer lands. If the question is answered correctly, the player will pick an ingredient card 39 or a wine card 41 from the appropriate box of cards. If it fits his recipe, he keeps it in his active recipe area 60; if not, it is kept in his pantry and wine cellar 62 for possible future use and he spins the wheel 48 again. A player continues to spin the wheel until a question is answered incorrectly or if a pot luck card chosen stops his turn.

If a player answers a question incorrectly or does not know the answer, (following in a clockwise direction), the next player may answer it, if he can. If not, the question moves around the table until it is answered correctly or comes back to the original player. If no one can answer the question, the answer is given and the play resumes to his immediate left. If the question is answered correctly by a player, he may take the appropriate action. Play then resumes to the original player's left.

If a player lands on a pot luck space 64 on wheel 48, player must draw a pot luck card 56. Pot luck card 56 requires some player action which may be positive or negative. The back side 66 of a pot luck card 56 states "Your vegetable garden has yielded a bumper crop this year —This card replaces any green vegetable needed for your recipe" which is positive for a player. However, the back side 68 of another pot luck card 56 states "A range fire causes you to lose your ingredients and singe your eyebrows" which is negative. The player who draws a pot luck card must follow the instructions on the back side of the pot luck card.

This play continues until all ingredient cards 39 are out, after which the open market begins.

The open market level of play occurs when all ingredient cards 39 have been acquired by the players. At this point in the game, when a player answers a question correctly, he is entitled to take any ingredient card 39 from any of his opponents—either to complete his recipe or to block his opponent from completing his recipe. If, during play, any ingredient cards 39 have to be returned to the stack, these cards must then be selected first before open market play continues. Play continues until one player completes his recipe, including the wine, and that player is the winner.

From the foregoing description of these embodiments of the invention, it will be apparent that many modifications may be made therein. For example, the recipes taught by the game are not limited to gourmet recipes. In addition, the invention is not only applicable to board and non-board games, but is also applicable to computer and video games and to game shows, as well as to other game formats. It will be understood, therefore, that these embodiments of the invention are exemplifications of the invention only and that the invention is not limited thereto.

What is claimed is:

1. A food preparation recipe game for one or more players comprising:

a spin wheel; said spin wheel having a pointer and a plurality of encoded possible landing spaces;

a plurality of recipe cards; each of which lists a plurality of ingredients;

a plurality of question and answer cards; each question and answer card having a plurality of questions and answers which are encoded for various degrees of difficulty; said encoding for said landing spaces corresponding to said encoding for said question and answer cards;

a plurality of ingredient cards; each ingredient card listing an ingredient of a food recipe, which ingredient may or may not correspond to an ingredient on a particular recipe card;

whereby a player is entitled to draw an ingredient card by correctly answering a question from said question and answer card.

2. A game as set forth in claim 1 wherein said recipe cards each includes the name of a wine and further including a plurality of wine cards; whereby a player is entitled to draw a wine card or an ingredient card, depending on a particular landing space, by correctly answering a question from said question and answer card.

3. A game as set forth in claim 2 wherein said encoded landing spaces on said spin wheel include requirements for drawing an ingredient card or a wine card.

4. A game as set forth in claim 3 further including a plurality of player action cards; said spin wheel including a plurality of landing spaces which require the player to draw a player action card.

5. A game as set forth in claim 4 wherein said player action cards include actions both positive and negative actions.

6. A game as set forth in claim 1 wherein said encoding of the landing spaces is in the form of color coding and the encoding of the question cards is in the form of color coding.

7. A game as set forth in claim 1 further including a card rack for holding an individual player's cards.

8. A game as set forth in claim 7 wherein said card rack includes an active recipe section and an inactive section.

9. A game as set forth in claim 1 wherein recipe cards include steps for using the recipe.

10. A method of playing a food preparation recipe game by a plurality of players comprising the steps of:

randomly selecting recipe informational media which lists a plurality of ingredients of a food recipe;

randomly selecting a question;

asking said question of a player;

upon said player correctly answering said question, selecting ingredient informational media which lists a food ingredient which may or may not correspond to one of the ingredients listed on the recipe informational media;

the first player accumulating all of the ingredients listed on his recipe informational media wins the game;

said recipe informational media is in the form of cards having recipes listed thereon.

11. A method as set forth in claim 10 wherein said ingredient informational media is in the form of cards having an ingredient listed thereon.

12. A method as set forth in claim 10 further including question and answer informational media.

13. A method as set forth in claim 12 wherein said question and answer informational media is in the form of cards having questions and answers listed thereon.

14. A method as set forth in claim 12 wherein said randomly selected question is a question from said question and answer informational media.

15. A method as set forth in claim 10 wherein said recipe informational media also lists a wine appropriate for the food and further including the step of selecting wine informational media which includes a wine which may or may not correspond with the wine on said recipe informational media.

16. A method as set forth in claim 15 wherein said wine informational media is in the form of cards having a wine listed thereon.

17. A method as set forth in claim 15 further including player action informational media which requires player action.

18. A method as set forth in claim 17 further including the step of randomly selecting one of said ingredient informational media, said wine informational media, or said player action informational media.

19. A method as set forth in claim 17 wherein said player action informational media requires a positive or a negative action.

20. A method as set forth in claim 19 wherein said positive action includes the acquisition of an ingredient for the player's recipe.

21. A method as set forth in claim 19 wherein said negative action includes the loss of the player's turn.

22. A method of playing a food preparation recipe game by a plurality of players comprising the steps of:

randomly selecting recipe informational media which lists a plurality of ingredients of a food recipe;

randomly selecting a question;

asking said question of a player;

upon said player correctly answering said question, selecting ingredient informational media which lists a food ingredient which may or may not correspond to one of the ingredients listed on the recipe informational media;

the first player accumulating all of the ingredients listed on his recipe informational media wins the game;

all of said ingredient informational media have been accumulated by the players, further including the step of selecting an ingredient informational media by a player from another player upon correctly answering a question.

* * * * *